US008487556B2

(12) United States Patent
Yu et al.

(10) Patent No.: US 8,487,556 B2
(45) Date of Patent: Jul. 16, 2013

(54) ULTRA-HIGH VACUUM PHOTOELECTRON LINEAR ACCELERATOR

(75) Inventors: David U. L. Yu, Rancho Palos Verdes, CA (US); Yan Luo, Manhattan Beach, CA (US)

(73) Assignee: Duly Research Inc., Rancho Palos Verdes, CA (US)

( * ) Notice: Subject to any disclaimer, the term of this patent is extended or adjusted under 35 U.S.C. 154(b) by 225 days.

(21) Appl. No.: 12/932,891

(22) Filed: Mar. 8, 2011

(65) Prior Publication Data

US 2012/0229053 A1 Sep. 13, 2012

(51) Int. Cl.
*H05H 9/04* (2006.01)

(52) U.S. Cl.
USPC ..... 315/505

(58) Field of Classification Search
USPC ..... 315/500, 505, 501, 506
See application file for complete search history.

(56) References Cited

U.S. PATENT DOCUMENTS

| | | | | |
|---|---|---|---|---|
| 4,209,552 | A * | 6/1980 | Welch | 427/78 |
| 5,101,167 | A * | 3/1992 | Ikegami | 315/500 |
| 5,401,973 | A * | 3/1995 | McKeown et al. | 250/492.3 |
| 5,434,420 | A * | 7/1995 | McKeown et al. | 250/396 R |
| 6,005,247 | A * | 12/1999 | Baum | 250/310 |
| 6,448,722 | B1 * | 9/2002 | Yu et al. | 315/505 |

* cited by examiner

*Primary Examiner* — Minh D A

(57) ABSTRACT

An rf linear accelerator for producing an electron beam. The outer wall of the rf cavity of said linear accelerator being perforated to allow gas inside said rf cavity to flow to a pressure chamber surrounding said rf cavity and having means of ultra high vacuum pumping of the cathode of said rf linear accelerator. Said rf linear accelerator is used to accelerate polarized or unpolarized electrons produced by a photocathode, or to accelerate thermally heated electrons produced by a thermionic cathode, or to accelerate rf heated field emission electrons produced by a field emission cathode.

13 Claims, 7 Drawing Sheets

ULTRA-HIGH VACUUM PHOTOELECTRON LINEAR ACCELERATOR

GOVERNMENTAL RIGHTS IN INVENTION

This invention was made with partial governmental support under Small Business Innovation Research (SBIR) Contract No. DE-FG02-06ER84460 awarded by the U.S. Department of Energy to DULY Research Inc. The government may have certain rights in the invention.

BACKGROUND OF THE INVENTION

1. Field of the Invention

The present invention provides a normal-conducting photoelectron linear accelerator for producing a low-emittance electron beam from a photocathode that operates in ultra high vacuum and under high heat load.

2. Description of the Prior Art

A polarized electron linear accelerator based on a Plane-Wave-Transformer (PWT) design was the subject of a prior U.S. Pat. No. 6,744,226, in which a plurality of iris-loaded disks are suspended by water cooling rods (or pipes) that are connected to two endplates of a cylindrical radiofrequency (RF) cavity. The electric field pattern in the cylindrical PWT cavity is such that a TEM-like mode, resembling the plane wave in free space, is sustained in the region between the outer diameter of the disks and the inner wall of the cylindrical cavity, while a TM01-like mode is sustained on and near the axis of the standing-wave PWT cavity. Because the disk (s) are not attached to any other parts of the cavity than the supporting rods, the PWT has excellent vacuum properties including a large vacuum conductance in the paths from the photocathode that is located on the back endplate to the vacuum pumps located outside the cavity. A polarized electron beam is generated from a GaAs cathode located in the center of the back endplate of the cavity when a polarized laser beam is impinged upon it. Ultra high vacuum (UHV) can be accomplished with conventional ion pumps as well as non-evaporative getters (NEG). In the previous invention, a NEG film is sputtered onto the inner surface of the cavity wall. The presence of the NEG film on the RF cavity wall, however, reduces the Q-factor of the cavity. Also in said invention the NEG-lined cavity wall is not replaceable. As the NEG pumping becomes less effective over time, the entire cavity would have to be replaced. The cooling of the disks, rods, endplates and other elements in the PWT cavity that are exposed to RF heating during electron acceleration is accomplished by water flowing through internal channels inside the disks, rods and other elements. The flow rates are determined by the external pressure head and by resistances through the pipes and orifices as well as those in the internal channels of the disks and walls of the cavity. The flow rates are predominantly limited by the flow area inside the pipes and the sizes of orifices, which in turn limit the amount of heat that can be removed from the surfaces of the cavity that are exposed to RF. Such limitations can become problematic when a high heat load such as that required when long RF pulses, a high rep rate and/or high power RF are imposed on the PWT cavity. What is desired under such circumstances is an RF cavity that operates in a UHV environment with replaceable NEG elements and if possible, without the flow restriction imposed by the rods, orifices and disks.

SUMMARY OF THE INVENTION

The present invention provides a method and apparatus to produce a high-quality electron beam from a photocathode which requires an ultra high vacuum for optimal operation, and to provide superior cooling in a half-cell photoelectron linear accelerator under high RF heat load. The invention provides an ultra high vacuum RF photoelectron linear accelerator design that has a perforated cavity wall through which residual gas inside the RF cavity is evacuated with ultra high vacuum pumps placed in a replaceable pressure chamber outside said perforated wall. Examples of UHV pumps are ion pumps, non-evaporative getter (NEG) modules or a NEG film sputtered on the inner surface of a pressure chamber surrounding the cavity. Even a low-temperature metal surface can be an UHV pump. In one embodiment of the invention, no disks and rods are needed in a half-cell cavity, while the cavity still retains the characteristic field pattern of the PWT. This embodiment allows effective cooling of the cavity walls without the limitation imposed on the flow rate by the small pipe and orifice sizes. The characteristic field pattern of the PWT includes a hybrid mode that has a TEM-like field in the outer region of the cavity and a TM-like field on and near the axis of a cylindrical RF cavity.

The invention has applications in polarized or unpolarized particle accelerators which require an ultra high vacuum. It is particularly applicable to electron accelerators in which electrons are produced from a semiconductor (such as GaAs) cathode. The method provides the UHV that is necessary in order to maintain good quantum efficiency and long life for the cathode. The embodiment of the invention of a photoelectron linac with no disks and rods, alternatively called a hybrid mode RF gun here, has particular application to electron guns that operate under a high heat load, such as a long pulse RF gun, or pulsed RF guns with a high rep rate, or continuous wave (CW) RF guns. The hybrid mode, half-cell, RF gun design is especially well matched to the features necessary for production of polarized electrons in a short, high gradient accelerator under high RF power. The linear accelerator in the present invention need not have photocathode as an electron source. An UHV condition that can be achieved with the present invention applies also to a thermionic cathode or a field emission cathode.

The features of the RF linac of the present invention include a cavity wall (or sieve) that has built-in, through-the-wall, longitudinal slots that are open to a replaceable pressure chamber surrounding the cavity. The pressure chamber contains non-evaporative getters either in the form or fabricated modules, available for example through SAES, or as a thin film comprising of NEG such as TiZrV that is directly deposited onto the inner surface of the said pressure chamber. The pumping through the slots and through the cavity is capable of providing the ultra-high vacuum condition especially needed for the survivability of the semiconductor photocathode such as GaAs. The size of said slotted openings in the cavity wall is specified so that RF waves are attenuated inside the slots while residual gases inside the cavity are allowed to flow through the slots to the pumps located outside the cavity. Additional pumps may be used to pump the cavity at locations other than the pressure chamber.

In one embodiment of the present invention, the hybrid mode cavity has no disks or rods but comprises instead of two concentric cylindrical regions of different outer diameters and different lengths to achieve the characteristic electrical field pattern of the PWT. The electrical field pattern comprises a TEM-like mode in the larger cylindrical cavity and a TM-like mode in the smaller cylindrical cavity close to the axis of the cavity.

In one embodiment of the rodless and diskless hybrid mode cavity, the RF coupler is coaxial with the cylindrical cavity. The coaxial coupler has an outer conductor and an inner conductor whose shape and dimensions are designed to allow the external RF power to critically couple into the standing wave RF cavity coaxially.

Having no rods and disks, the hybrid mode cavity is cooled efficiently by ordinary liquid such as water that flows through internal channels embedded in cavity walls. The slotted outer wall (sieve) of the cavity has separate longitudinal internal channels that carry flowing water. Pressurized deionized water is fed into the internal channels via external pipes. Having no rods and orifices that incur high pressure drops, the cooling of the hybrid mode cavity is thus highly efficient.

DESCRIPTION OF THE DRAWINGS

For a better understanding of the present invention as well as other objects and further features thereof, reference is made to the following descriptions which are to be read in conjunction with the accompanying drawing wherein.

DESCRIPTION OF THE INVENTION

Figure 1:
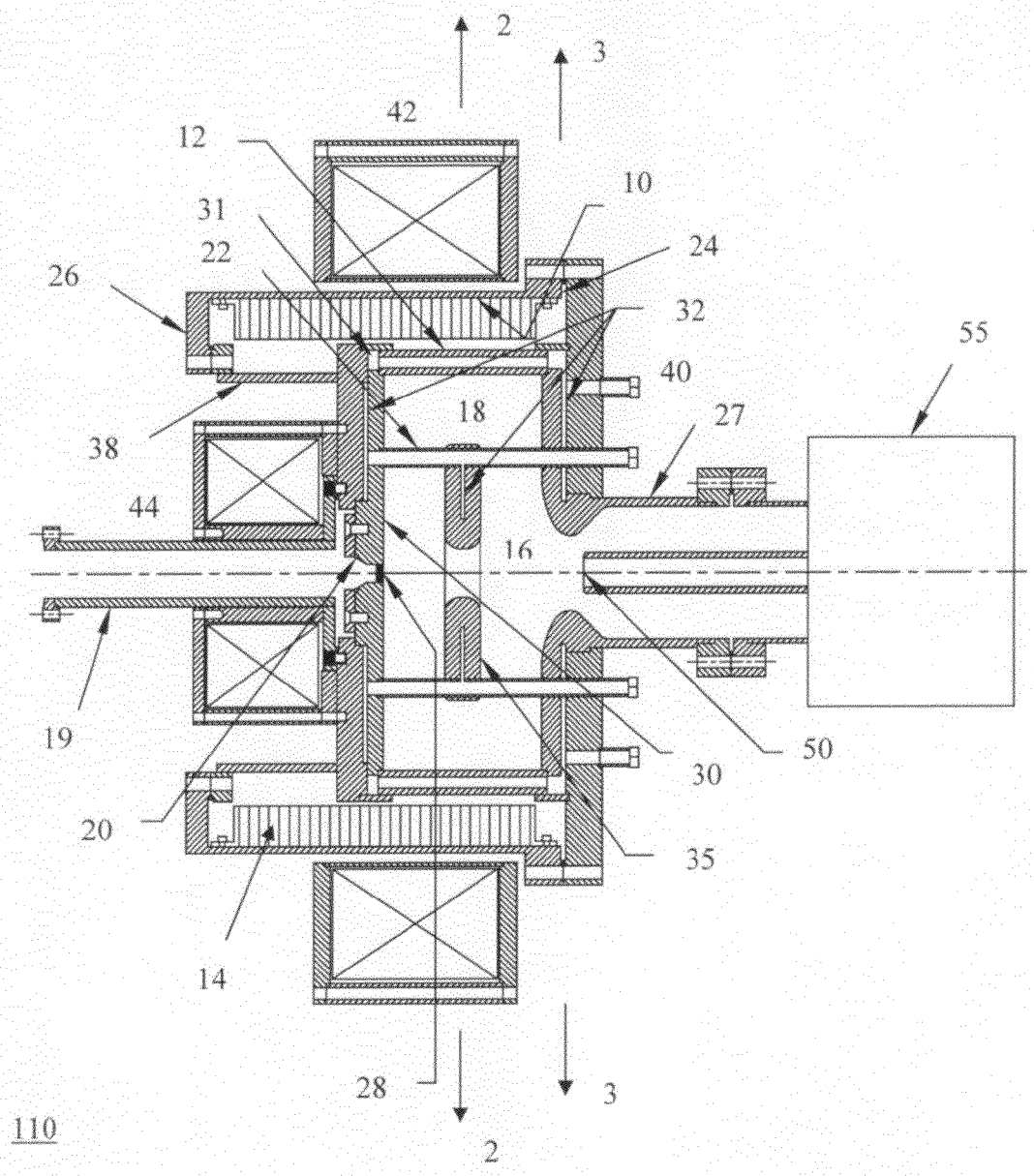
FIG. 1 is a schematic diagram of the ultra high vacuum, PWT photoelectron linear accelerator with rods and one disk, with a replaceable pressure chamber surrounding the cavity.
Figure 3A:
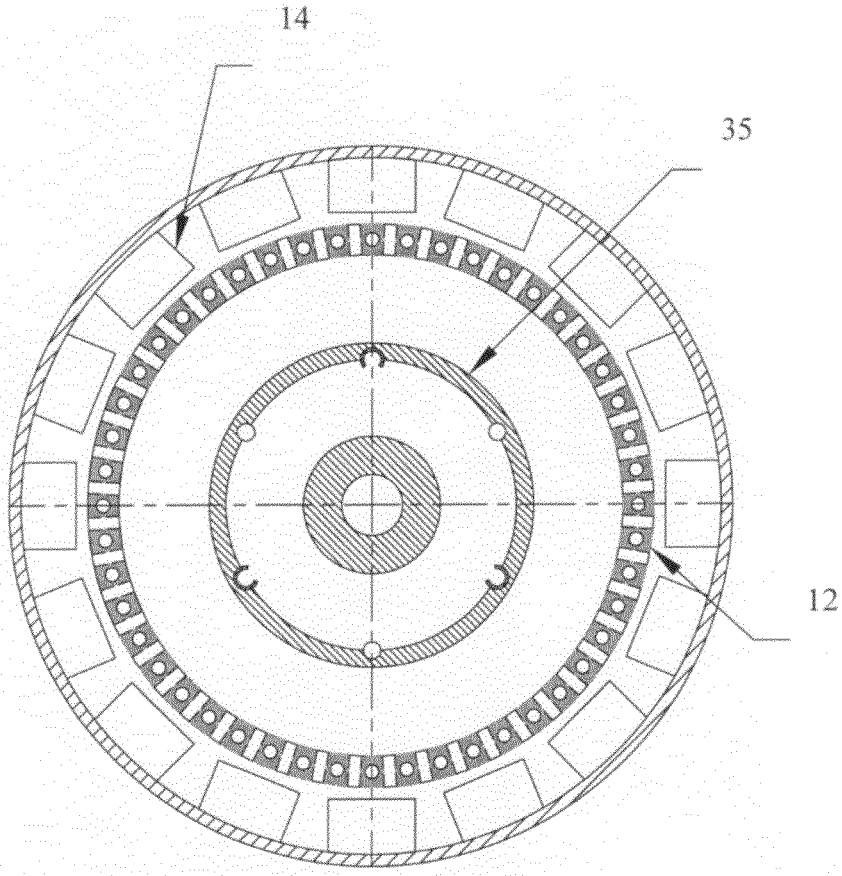
FIG. 3*a* is a cross-sectional view along line 2-2 of FIG. 1.
Figure 3B:
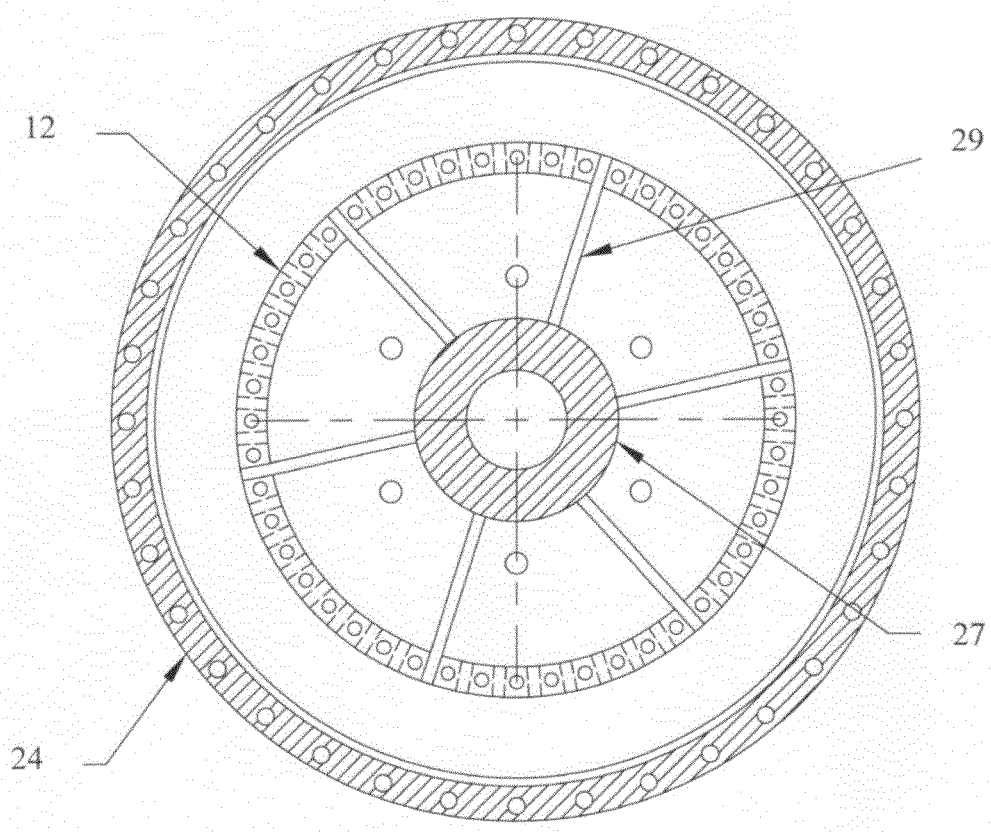
FIG. 3*b* is a cross-sectional view along line 3-3 of FIG. 1.

The ultra high vacuum (UHV) photoelectron linear accelerator (linac) of the present invention with the modified PWT design 110, or hybrid mode design 120, comprises a radiofrequency cavity having a porous outer wall 12 through which is connected a pressure chamber 10 that houses non-evaporative getter (NEG) material 14 for ultra high vacuum pumping. The NEG pumps may be commercially available NEG modules (for example, SAES) 14 mounted on the inside wall of the pressure chamber 10, or a layer of NEG film sputtered directly onto the inside wall of the pressure chamber 10. The removable pressure chamber 10 is attached to the body of the linac 110 or 120 via a standard Conflat flange 24, and a second Conflat flange 26 that is inverted from the standard design. The standard Conflat flange 24 has a bolt circle on the outside of the knife edge. The inverted Conflat flange 26 has a bolt circle on the inside of the knife edge. The mating inverted Conflat flange 26 is optionally connected to a bellows or an eyelet 38 that has both vertical and horizontal degrees of freedom. The porous cavity wall 12, or "sieve", has longitudinal slots through it. The width of the slot is smaller than the cutoff dimension of the RF wave in order to prevent the RF power inside the RF cavity from leaking into the pressure chamber 10. In one embodiment of the UHV linac 110 of the plane wave transformer (PWT) design, illustrated in FIG. 1 and FIG. 3, the RF cavity is formed by one or more iris-loaded disk(s) 35 that is (are) supported by rods (or pipes) 22 that are anchored to the endplates of the cavity. The pipes 22 carry liquid coolant, for example water, that flows into channels 32 imbedded inside the disk(s) 35 and the first endplate. Cooling of the RF cavity of the linac 110 is additionally provided by a water circuit comprising pipes 40 and channels 32 imbedded inside the second endplate of the cavity, and by longitudinal channels inside the sieve 12. The inlet and outlet flows in the cooling circuit in the endplate 27 are separated by flow dividers 29 which direct flow through internal compartments into flow channels in the sieve 12, said flow is connected by a circumferential channel or reservoir 31 in the opposite endplate 30. The UHV PWT 110 has a demountable photocathode 28 located at the center of the back endplate 30. Electrons are produced from the photocathode 28 when a laser pulse is directed into the cavity nearly along the axis of the cavity by an optical system located outside the cavity. An RF seal 20 is inserted between a cathode puck (not shown) that holds the cathode 28 in place and the back endplate 30 to prevent the RF power from leaking out of the cavity. For a short RF cavity where is insufficient room for an RF side coupler, RF power is fed into the cavity by means of a coaxial coupler 50 which is connected to an external RF coupler 55, for example, a doorknob coupler of the DESY design. Additional pumping devices such as ion pumps, may be connected to the external RF coupler 55 or the pressure vessel 10 to further improve the vacuum in the cavity. The electromagnetic field in the PWT cavity is characterized by two modes present respectively in two distinct regions of the standing wave cavity: An inner region 16 in which a TM-like mode is present to provide an axial electric field, typically that of the "π" mode, for acceleration of the electron beam; and an outer region 18 in which a TEM-like mode is present. In one embodiment of the UHV PWT linac with disks, the inner region 16 occupies a cylindrical volume extending from one endplate to the other, with a diameter approximately the same as the outer diameter of the disk(s), and the outer region 18 occupies the rest of the cavity volume outside the disk(s). A PWT cavity of this invention with a single disk design operating in the "π" mode is illustrated in FIG. 1, where the distance between the back endplate 30 and the disk 35, as well as that between the disk 35 and the front endplate 27, is approximately one-quarter wavelength long in the longitudinal direction. If no RF side coupler is used so that the entire porous cavity wall (sieve) provides the maximum vacuum conductance through said wall, the PWT cavity 110 is critically coupled via a coaxial coupler 50 to an external RF power source. The electron beam accelerated in the PWT cavity 110 is focused by means of emittance-compensating magnets comprising a main solenoid 42 and a bucking solenoid 44.

Figure 2A:
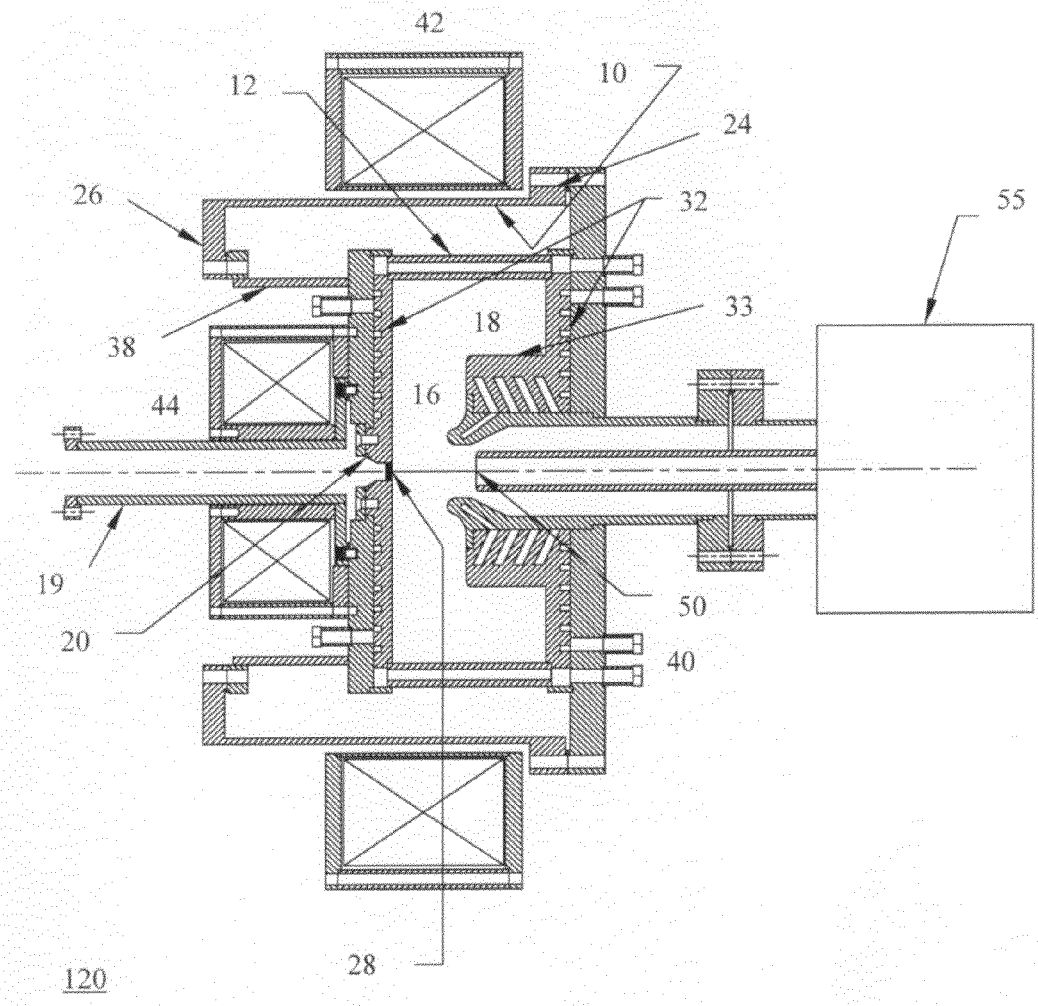
FIG. 2*a* is a schematic diagram of the ultra high vacuum, hybrid mode cavity without rods and disks.
Figure 2B:
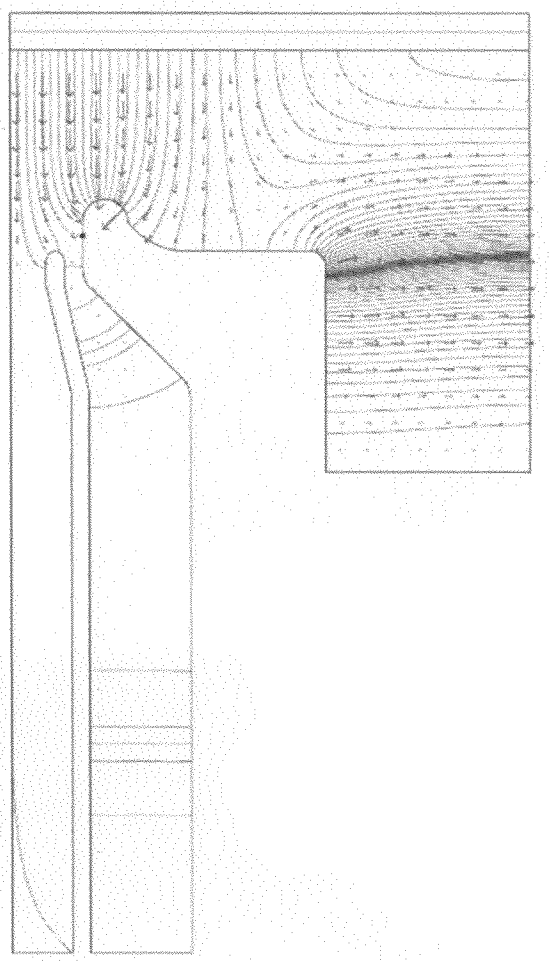
FIG. 2*b* is a two dimensional electric field map from Superfish for the RF cavity shown in FIG. 2*a;*
Figure 4:
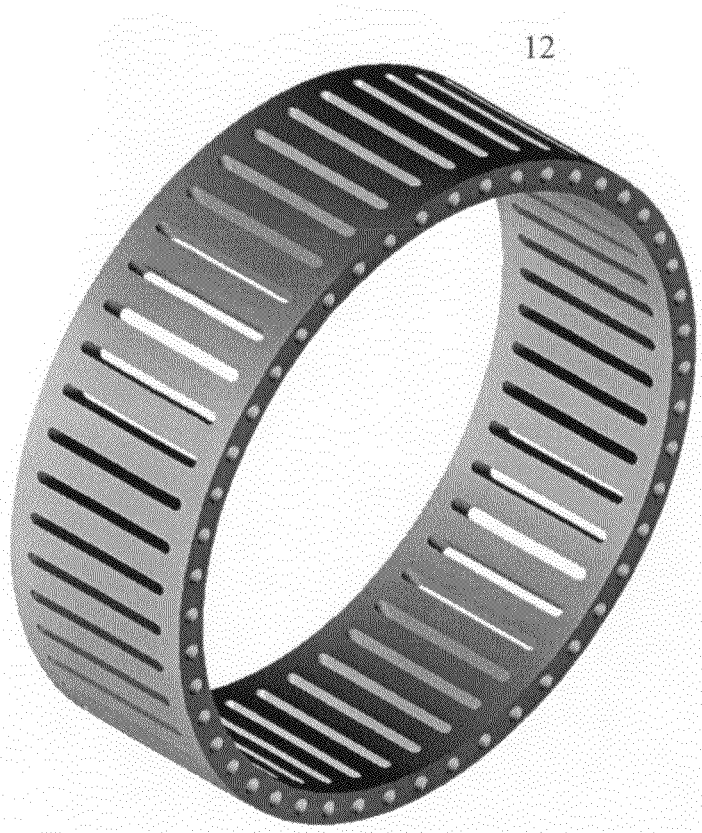
FIG. 4 illustrates the slotted wall or sieve of the hybrid mode cavity or the modified PWT.

A second embodiment of the UHV linac 120 with a modified PWT design is shown in FIG. 2, for which no disk or supporting pipes are needed. The hybrid mode cavity 120 is formed instead by two conjoined and concentric cylindrical regions 16 and 18 with different axial lengths. The inner region 16 occupies a cylindrical volume approximately one-quarter of a wavelength long. The outer region 18 occupies a longer coaxial volume immediately outside the inner region 16. Its outer wall comprises the porous wall or sieve of the UHV PWT linac. In this variant of the rodless and diskless UHV PWT, the endplates of the UHV PWT 120 are cooled with flow inside imbedded channels 32. A photocathode 28 is placed at the center of the first endplate of the integrated PWT linac 120. The front endplate 33 has a top hat shape, shown in FIG. 2, that defines the lengths of the PWT cavity regions 16 and 18. The iris of the front endplate 33 can further be shaped with a nose to increase the shunt impedance of the cavity. External pipes 40 feed coolant into imbedded channels inside the endplates. The pipes 40 can be as large as needed to provide the desired flow to cool the endplates. The sieve 12, of which a three dimensional rendering is shown in FIG. 4, is cooled by coolant inside longitudinal flow channels fed by separate external pipes 40. In this embodiment, RF power is critically coupled into the UHV PWT cavity 120 via a coaxial coupler 50 and an external RF coupler 55.

Figure 5:
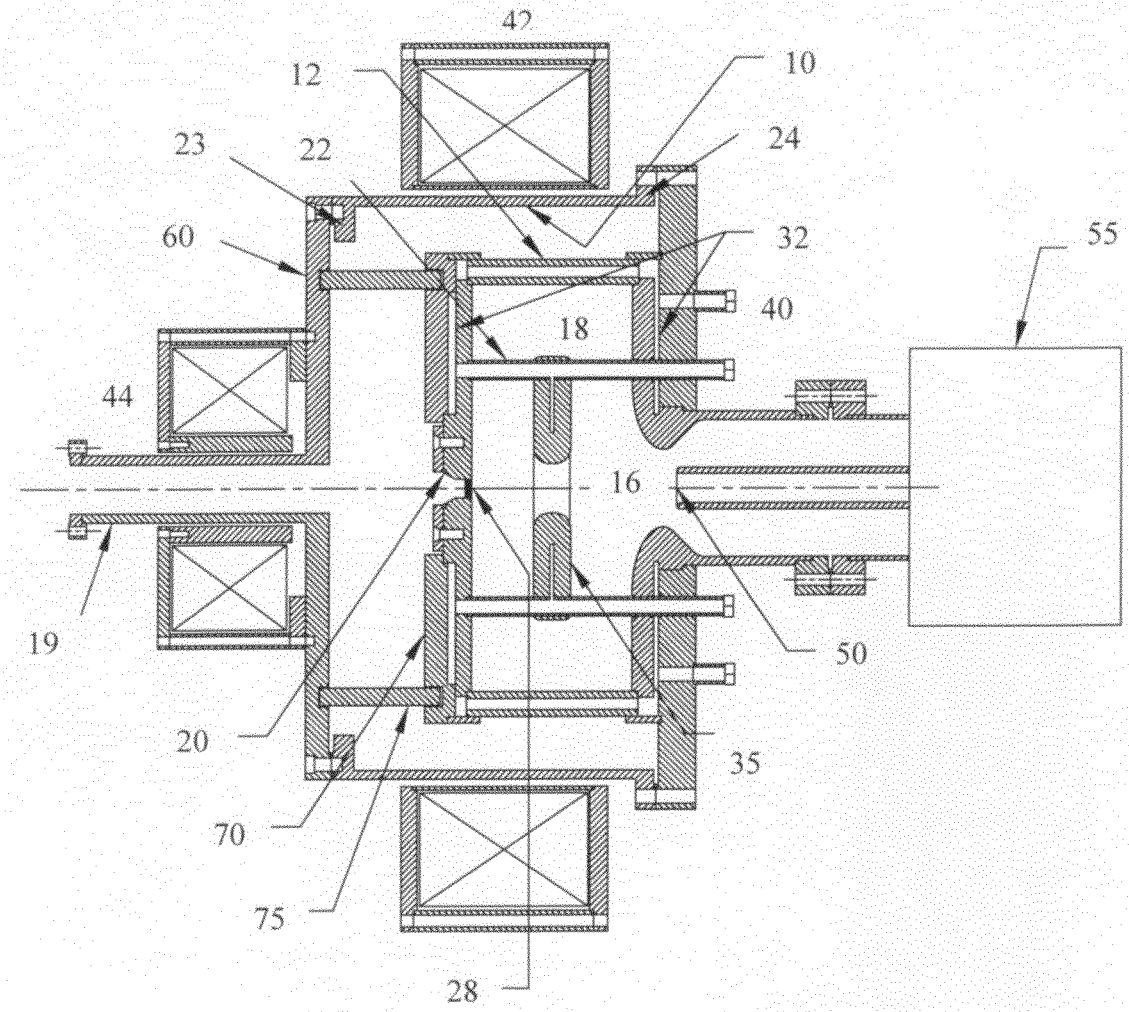
FIG. 5 illustrates an alternative design of the replaceable pressure chamber that houses the NEG pump.

The replaceable pressure chamber 12, shown in FIG. 1 and FIG. 2 includes an inverted Conflat flange 26, optionally connected to a flexible eyelet 38, to allow adequate compression of the gasket between the two knife edges and proper alignment of the bolt holes between the pair of inverted Conflat flanges in order to provide a good vacuum seal. An alternative design of the replaceable pressure chamber 12 is shown in FIG. 5. In this design, standard Conflat flanges are used on both ends of the pressure chamber 12. One of the Conflat flanges 24 is connected to the body of the RF cavity as in the aforementioned design, while the other standard Conflat flange 23 is connected to a mating flange on a circular cover plate 60 that forms part of the pressure chamber which is brazed to the cathode tube 19. Pins 75 may be used to align the pressure chamber cover plate 60 with the endplate 70 in the body of the RF cavity.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A compact, radio-frequency driven, electron linear accelerator having a longitudinal axis for producing an electron beam comprising:

a plurality of cylindrical disks positioned inside a large cylindrical tank which is capped at either end with an end plate; said disks being supported by a plurality of cooling rods that are suspended between said end plates;

means for applying high-frequency rf power to said tank and converting the rf power to an electric field along the longitudinal axis of the said disks;

a cathode located at the center of one of said end plates, capable of producing electrons that are accelerated through said accelerator;

magnet focusing system positioned in operative relationship to said accelerator for focusing the charged electron beam; and a plurality of longitudinal slots through the outer wall of the rf cavity of said accelerator; and means of ultra high vacuum pumping of said cathode through said longitudinal slots.

2. The linear accelerator of claim 1 wherein the rf cavity of said accelerator is a plane wave transformer.

3. A compact, radio-frequency driven, electron linear accelerator having a longitudinal axis for producing an electron beam comprising:

a ½-cell rf cavity with no cooling rods inside said cavity; said cavity comprising an outer region and an inner region; said outer region of the said cavity supporting a TEM-like mode and said inner region of said cavity supporting a TM-like mode;

means for applying high-frequency rf power to said tank and converting the rf power to an electric field along the longitudinal axis of the said rf cavity;

a cathode located at the center of one of one of the end plates of said rf cavity, capable of producing electrons that are accelerated through said accelerator;

magnet focusing system positioned in operative relationship to said accelerator for focusing the charged electron beam; and a plurality of longitudinal slots through the outer wall of the rf cavity of said accelerator;

and means of ultra high vacuum pumping of said cathode through said longitudinal slots.

4. The linear accelerator of claim 1 or claim 3 wherein said rf cavity comprising two concentric regions, the outer region having a longer length than the inner region which has an active acceleration length of approximately one-quarter of the rf wavelength.

5. The linear accelerator of claim 3 wherein said rf cavity is a hybrid mode cavity.

6. The linear accelerator of claim 1 or claim 3 wherein said rf cavity is surrounded by a pressure vessel in which a getter material is used to provide ultra high vacuum pumping.

7. The linear accelerator of claim 1 or claim 3 wherein said rf cavity is surrounded by a pressure vessel that is connected to an ion pumping to provide ultra high vacuum pumping.

8. The cathode in claim 7 being made of semiconductor material such as Gallium Arsenide, capable of producing a polarized electron beam when illuminated by a polarized laser beam.

9. The linear accelerator of claim 7 further including a load lock to maintain a high vacuum condition within said tube.

10. The linear accelerator of claim 1 or claim 3 wherein said rf cavity is surrounded by a pressure vessel in which a large, low temperature surface is used to provide ultra high vacuum pumping.

11. The linear accelerator of claim 1 or 3, wherein said cathode is a photocathode that can generate pulsed electrons upon illumination by a pulse laser beam.

12. The linear accelerator of claim 1 or 3, wherein said cathode being a thermionic cathode that can be heated externally to generate an electron beam to be accelerated in said linear accelerator.

13. The linear accelerator of claim 1 or 3, wherein said cathode being a field emission cathode that can be heated by the rf field at the surface of said cathode to extract an electron beam from said cathode to be accelerated in said linear accelerator.

* * * * *